US007249703B2

(12) United States Patent
Leapman

(10) Patent No.: US 7,249,703 B2
(45) Date of Patent: Jul. 31, 2007

(54) DEVICE FOR ASSISTING IN THE REMOVAL OF CONTENTS FROM ITS PACKAGING

(75) Inventor: Scott Leapman, Sioux City, IA (US)

(73) Assignee: Gateway Inc., Irvine, CA (US)

( * ) Notice: Subject to any disclaimer, the term of this patent is extended or adjusted under 35 U.S.C. 154(b) by 0 days.

(21) Appl. No.: 10/301,003

(22) Filed: Nov. 21, 2002

(65) Prior Publication Data

US 2004/0099721 A1 May 27, 2004

(51) Int. Cl.
*B65D 5/44* (2006.01)

(52) U.S. Cl. ..... 229/800; 229/122.1; 229/163; 229/243; 414/288

(58) Field of Classification Search ..... 229/100, 229/122.1, 163, 243, 198.1, 198.3, 800, 121, 229/122; 206/804; 414/288, 403, 416.01, 414/808, 810, 811; 221/302, 305
See application file for complete search history.

(56) References Cited

U.S. PATENT DOCUMENTS 292,802 A * 2/1884 Gowdy et al. ..... 229/122
2,136,184 A * 11/1938 Fellowes ..... 229/117.23
3,066,843 A * 12/1962 Neil ..... 229/122.1
3,099,379 A * 7/1963 Stease ..... 229/198.1
3,265,283 A * 8/1966 Farquhar ..... 229/122.1
3,300,115 A * 1/1967 Schauer ..... 221/305
3,357,542 A * 12/1967 Aquino et al. ..... 206/279
3,492,875 A * 2/1970 Tonjes ..... 175/207
3,568,911 A * 3/1971 Bebout ..... 221/305
3,701,466 A * 10/1972 Woodrow et al. ..... 221/305
3,869,077 A * 3/1975 Tuura ..... 229/123
3,891,137 A 6/1975 Ellison et al.
4,009,819 A * 3/1977 Miller et al. ..... 229/193
4,375,258 A * 3/1983 Crayne et al. ..... 229/121
4,498,581 A * 2/1985 Dutcher ..... 229/243
4,739,922 A * 4/1988 Zimmermann ..... 229/122.1
4,899,929 A * 2/1990 Grollman ..... 229/122.1
5,011,021 A 4/1991 Coltrane et al.
5,368,194 A * 11/1994 Oliff et al. ..... 221/305
5,503,325 A * 4/1996 Nelson et al. ..... 229/125.39
5,622,309 A * 4/1997 Matsuda et al. ..... 229/243

* cited by examiner

*Primary Examiner*—Gary E. Elkins
(74) *Attorney, Agent, or Firm*—Jeffrey A. Proehl; Woods Fuller Shultz & Smith PC

(57) ABSTRACT

Foldout tabs for assisting with the removal of contents from a carton. When extended, the foldout tabs provide a leverage point on which a user may place one or both feet so that while pulling the contents from within the carton, the carton does not exhibit its normal tendency to follow the contents.

15 Claims, 6 Drawing Sheets

DEVICE FOR ASSISTING IN THE REMOVAL OF CONTENTS FROM ITS PACKAGING

FIELD OF THE INVENTION

The present invention generally relates to the field of packaging. More particularly, the present invention relates to an apparatus to assist in removing contents from packaging or shipping carton and a method for removing such contents.

BACKGROUND OF THE INVENTION

As evident from the huge expansion in mail order and Internet shopping, many more products are being purchased and delivered in packaging or boxes. Furthermore, many consumer and business products that are purchased in retail outlets are provided in packaging or boxes. In many cases, the internal packing materials and the weight of the enclosed products tend to make it difficult to remove the purchased goods from the shipping carton, especially when the contents are bulky and/or heavy. This is due to at least three factors: the weight of the product, the friction of the packing material as it is pulled from the shipping carton and the air pressure or the vacuum created as the product is pulled out of the shipping carton. All these factors make it more difficult to remove the product from the shipping carton. As the user pulls on the product or packing material to remove it from the shipping carton, the shipping carton tends to move in the same direction.

Furthermore, the actions of the user sometimes make this situation worse. When the shipping carton moves with the product during removal, the industrious user will try to use his or her legs to hold the carton in place. This not only causes the user to exert pressure in a way that is not natural to them, but as they put pressure on the box, the box deforms, putting further pressure on the packing material or product, making the task even more difficult.

SUMMARY OF THE INVENTION

The present invention is directed to a device for assisting in the removal of a product from its carton. The product can be anything, but the intended advantages of this invention are best realized when the product is bulky or relatively heavy. Examples of such products are, but not limited to, computer systems, computer monitors, microwave ovens, television sets, water softeners, mattresses and even kitchen sinks.

This invention provides for one or more tabs that may form part of the shipping carton during shipping, but fold out so that the user can use the tab to provide leverage while pulling out the contents of the shipping carton. For example, a computer shipping carton may have tabs disposed on opposite sides of the shipping carton, substantially close to the bottom of the carton and preferable, but not necessarily, near the heavier part of the contents. The user would fold out the tab or tabs by pushing in a finger/thumb hole then pulling out the tab along a perforation. The user can then place his or her feet on one or two tabs, hence holding the shipping carton substantially on the floor while lifting its contents, e.g., the computer. The pop-out tabs provide a means for keeping the shipping container in place while pulling on its contents while also providing an opening in the bottom area of the shipping carton to allow an equalization of air pressure to reduce the effects of a vacuum created as the contents are removed.

In many cases, one or two foldout tabs are sufficient to provide leverage for a single user to remove the contents from a shipping carton, but in some cases, due to size or weight, some contents require more than one user to get the contents out of the shipping carton. In this case, any number of pop-out tabs can be employed.

In another embodiment of this invention, the foldout tabs may not be pop-out tabs, but rather, be separate from the shipping container and attached to the shipping container using glue, tape, rivets, screws or any existing fastening method. This embodiment provides the leverage of the above embodiments, but does not cut into the shipping carton, thereby not providing the advantage of reducing vacuum. This embodiment does have the advantage of not altering the shipping carton, and therefore can be added as an optional component. Additionally, the shipping carton would not be altered by the user when they remove its contents, thereby providing a more reliable, sealed shipping carton should any of its contents need be shipped to another destination.

In many cases, it is envisioned that the foldout tabs may be an integral component of the shipping carton or a separate component that is permanently affixed to the shipping carton before the user received the carton. Alternately, reusable foldout tabs may be provided as an optional component, possible shipped within the carton, that have spikes or an adhesive layer that allow the user to attach them to any carton to assist in the removal of the carton's contents.

Although this invention has been described, for the most part, in relation to packaging material or shipping cartons, the concept of a foldout tab can be applied to many objects and this invention is not limited to packaging material of shipping cartons. For example, the disclosed invention can be used in storage cartons or boxes, or at the bottom of a trash container, perhaps one made of plastic for household use. Many people use plastic bags that fit snuggly in such containers, but have difficulty removing the plastic bag and its contents due, mostly, to friction and vacuum. If this invention was applied to opposite sides of such a container, the user could flip down the two feet, creating an opening at the base of the trash container for air to flow in, hence reducing vacuum. Furthermore, the feet would serve as a leverage point to hold down the trash container while the trash is lifted out.

It is to be understood that both the forgoing general description and the following detailed description are exemplary only and are not restrictive of the invention as claimed. The general functions of this invention may be combined in different ways to provide the same functionality while still remaining within the scope of this invention. Although the descriptions generally use the terms, "shipping carton," "contents" and pop-out tab, this invention is not restricted to packaging used only for shipping, any particular contents including packing material and any specific method of providing a foldout tab.

DESCRIPTION OF THE DRAWING FIGURES

The numerous advantages of the present invention may be better understood by those skilled in the art by reference to the accompanying figures in which.

DETAILED DESCRIPTION

Reference will now be made in detail to the presently discussed embodiment of the current invention, examples of which are illustrated in the accompanying drawings.

Figure 1:
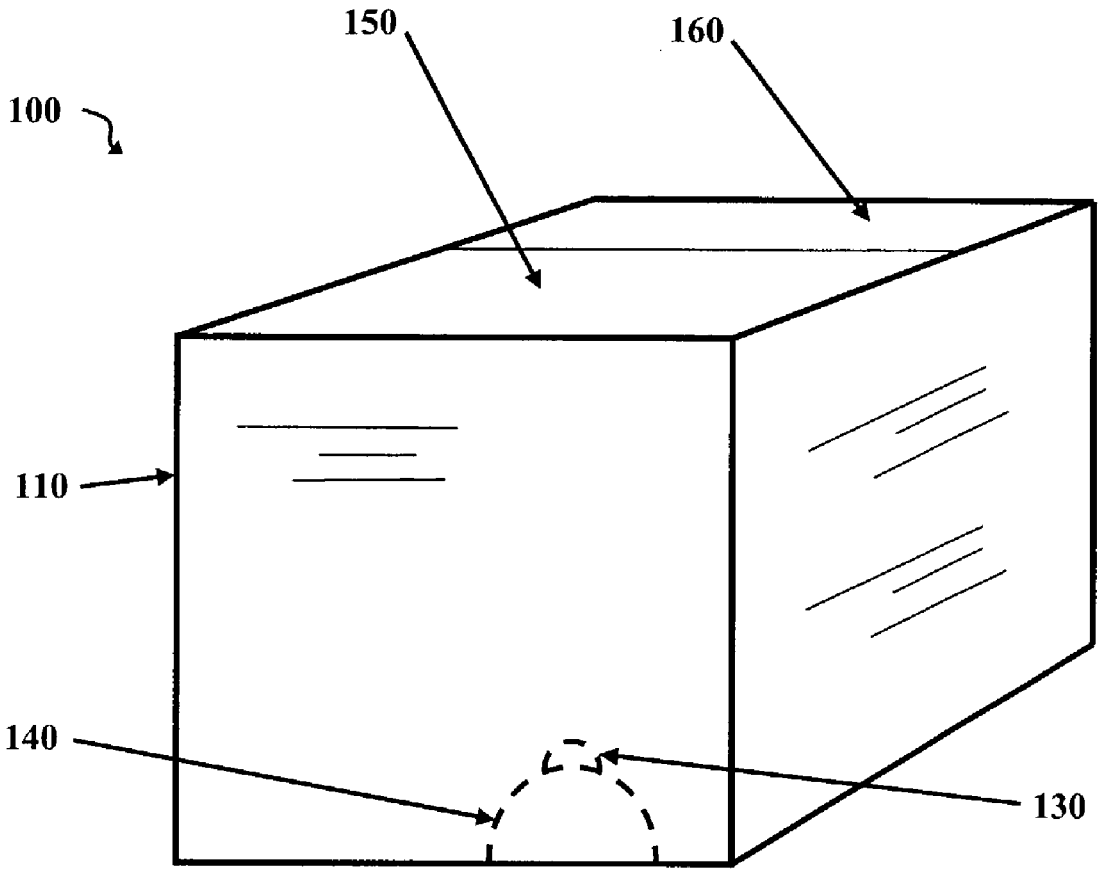
FIG. 1 shows a shipping carton with a single foldout tab.

FIG. 1 shows a shipping carton comprising a foldout tab in accordance with the present invention. The shipping carton 110 has two flaps 150 and 160 that flip open to allow access to the contents (not shown). The foldout tab of some embodiments comprises a finger tab 130, as shown, that allows the user to press a finger or thumb into the box so that they can easily pull out the foldout tab 140. This finger tab 130 and the foldout tab 140 may be perforated to help the user in pulling them from the shipping carton 110 and so that the foldout tab 140 and finger tab 130 can be cleanly separated from shipping carton 110.

Figure 2:
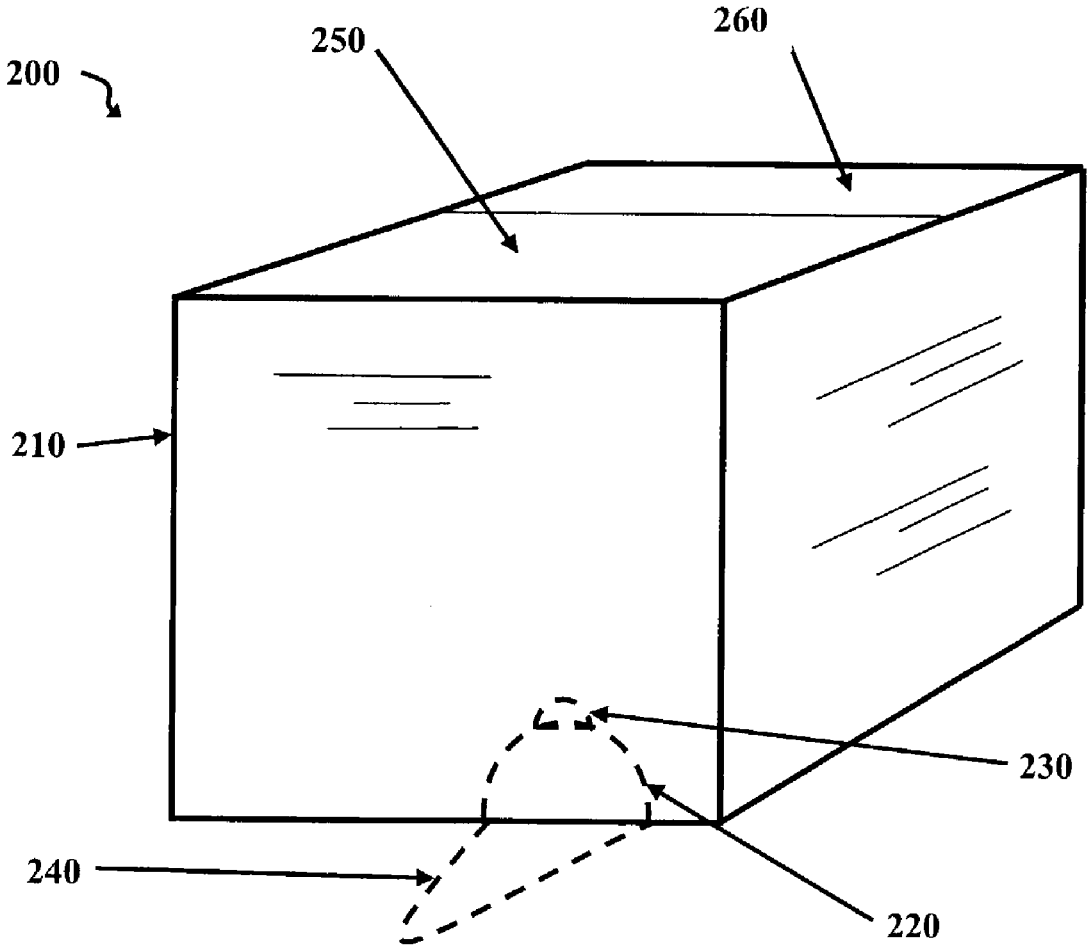
FIG. 2 shows the same shipping carton with the single foldout tab in the extended position where the user can step on it to aid in the removal of the contents of the shipping container.

FIG. 2 shows a shipping carton comprising a foldout tab in accordance with the present invention. The shipping carton 210 has two flaps 250 and 260 that flip open to allow access to the contents (not shown). The foldout tab 240 of this embodiment is shown in the extended mode. It comprises a finger tab 230 that allows the user to press a finger or thumb into the box so that they can easily pull out the foldout tab 240. This finger tab 230 and the foldout tab 240 are preferably perforated to help the user in pulling them from the shipping carton 210 and so that the foldout tab 240 and finger tab 230 can be cleanly separated from shipping carton 210. Once folded out, the foldout tab 240 lays substantially on the floor, and provides a place where the user can place their foot to gain leverage while removing the contents from shipping carton 210. Furthermore, after being folded out, the opening 220 in shipping carton 210 can be configured to provide a path for air to enter shipping carton 210 to reduce vacuum while pulling the contents out.

Figure 3:
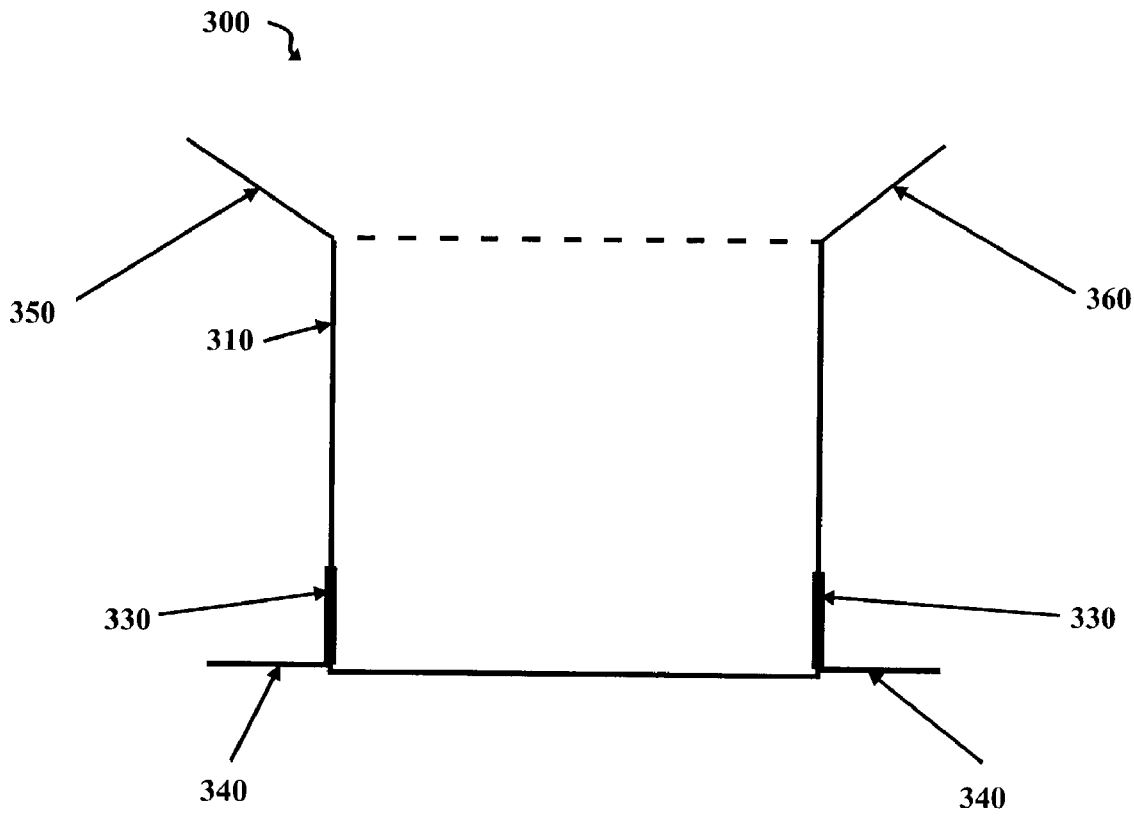
FIG. 3 shows a two-dimensional side view of a shipping carton with two foldout tabs that are attached to the outside of the carton.

FIG. 3 shows, in two dimensions, a shipping carton comprising a foldout tab in accordance with the present invention. The shipping carton 310 has two flaps 350 and 360 that are shown in the open position in order to allow access to the contents (not shown). The foldout tabs of this embodiment are shown in the extended mode. Each tab assembly comprises a base plate 330 that is attached to shipping carton 310 either using an adhesive or some other type of fastener and a tab 340 shown extended, that snaps into base plate 330 when not in use. Once one or both tabs 340 are extended to lay substantially on the floor, they provide a place where the user can place their foot or feet to gain leverage while removing the contents from shipping carton 310. Note, that since this embodiment does not make an opening in the side of shipping carton 310, it will tend to be easier to re-use said shipping carton 310, but without the openings, there will be no reduction in vacuum when removing contents.

Figure 4:
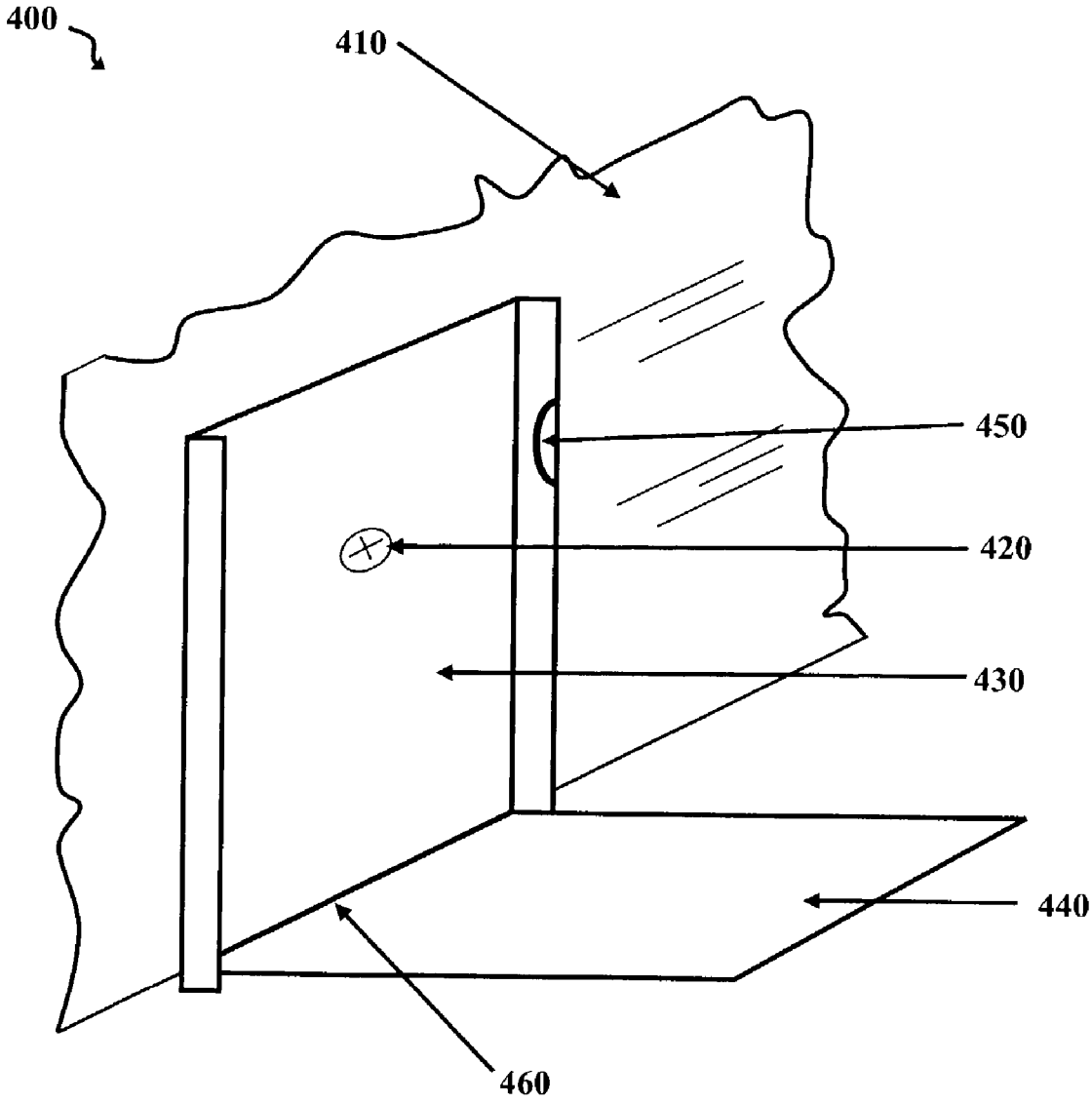
FIG. 4 shows a foldout tab that is a separate component and is attached to a shipping carton.

FIG. 4 shows a foldout tab in accordance with the present invention. A cutaway view of the shipping carton 410 is shown to highlight details of the foldout tab design. The foldout tab 440 of this invention is shown in the extended mode. The tab assembly comprises a base plate 430 that is attached to shipping carton 410 using one or more fasteners 420. Base plate 430 may also be attached to shipping carton 410 by various other methods including, for example; adhesive, glue, tape, rivets, screws or the like. Once tab 440 is extended to lie substantially on the floor, it provides a place where the user can place their foot to gain leverage while removing the contents from shipping carton 410. Note, that since this embodiment does not make an opening in the side of shipping carton 410, it will tend to be easier to re-use said shipping carton 410, but without the openings, there will be no reduction in vacuum when removing contents. When not in use, the foldout tab 440 can be snapped into an upright and flush position and held in place by snap 450. The foldout tab 440 and the base plate 430 may be constructed of many different materials. For example, foldout tab 440 may be made out of rubber, plastic, metal or cardboard. Flexible plastic may be used since hinge 460 may be constructed during the molding process or after the part is molded by thinning the plastic at hinge point 460 so foldout tab 440 can easily be moved between the upright, flush position and the extended position.

Figure 5:
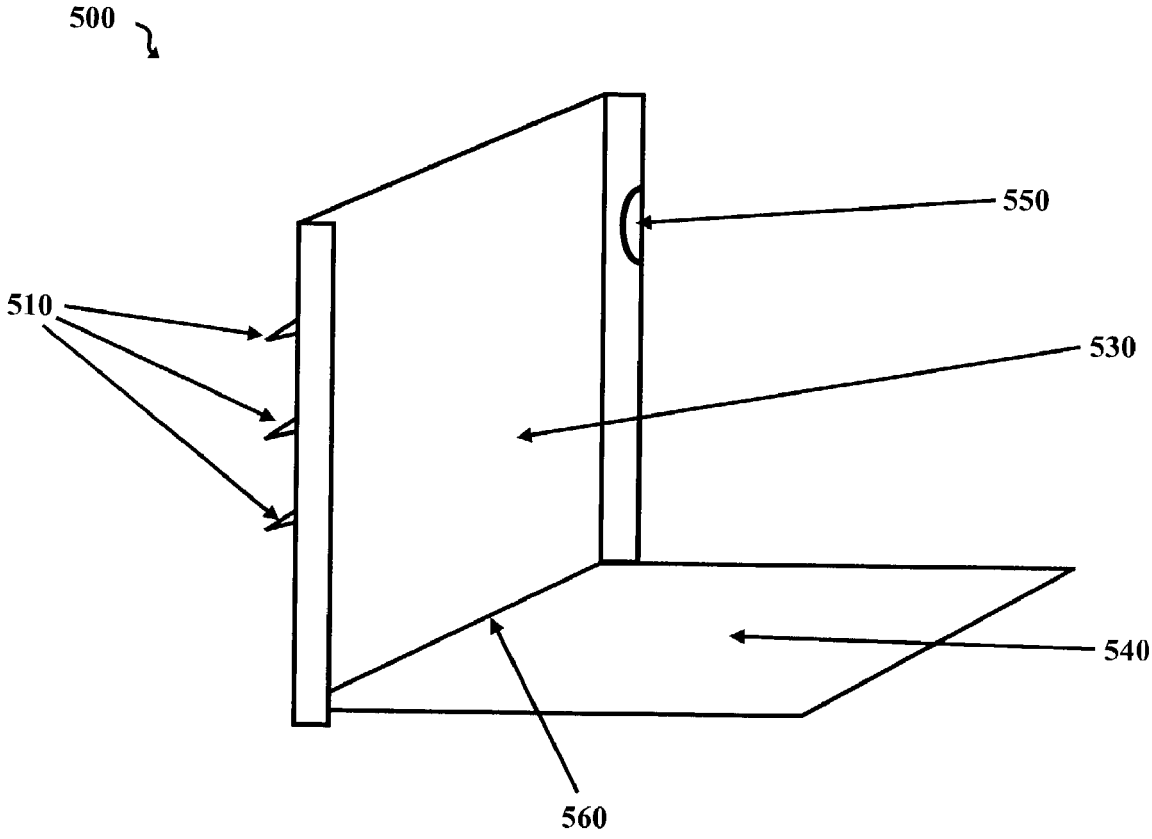
FIG. 5 shows a foldout tab that can be attached to various shipping cartons by the user.

FIG. 5 shows a foldout tab in accordance with the present invention. The foldout tab 540 of this embodiment is shown in the extended mode. The tab assembly comprises a base plate 530 that is shown unattached to any shipping carton. Base plate 530 may be attached by the user to most any cardboard (or similar material) shipping carton by piercing the outer surface of the shipping carton with thorns 510. Alternatively, base plate 530 may have an adhesive backing for attaching it to a carton instead of thorns 510 or in addition to thorns 510, but this would limit the ability to reuse the foldout tab 540. Once tab 540 is attached to the shipping carton and extended to lie substantially on the floor, it provides a place where the user can place their foot to gain leverage while removing the contents from shipping carton. When not in use, the foldout tab 540 snaps into an upright and flush position and is held in place by snap 550. The foldout tab 540 and the base plate 530 may be constructed of many different materials. For example, foldout tab 540 may be made out of rubber, plastic, metal or cardboard. Flexible plastic may provide the best material since hinge 560 may be constructed during the molding process or after the part is molded by thinning the plastic at hinge point 560 so foldout tab 540 can easily be moved between the upright, flush position and the extended position.

Figure 6:
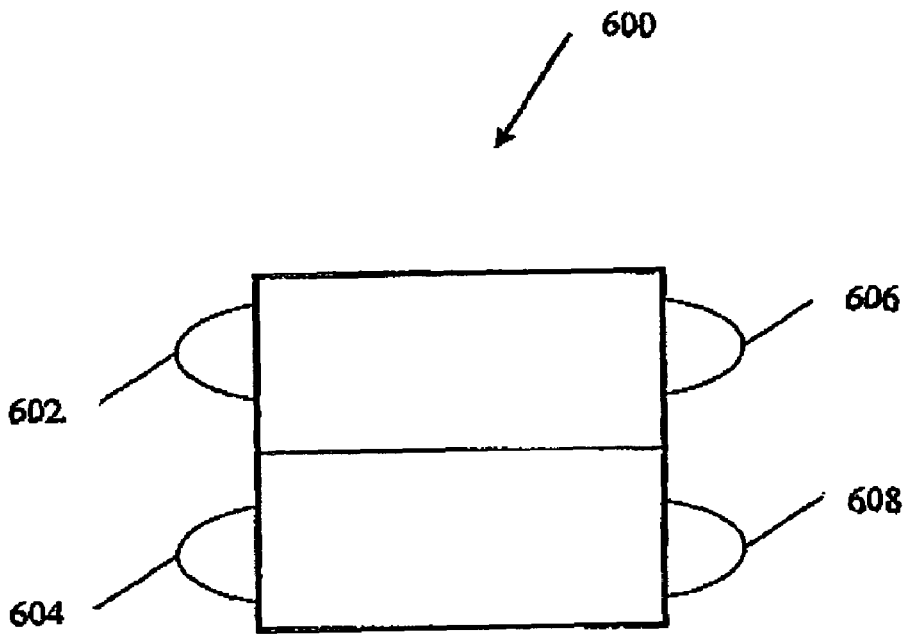
FIG. 6 shows a top view of a shipping carton has two foldout tabs disposed on each of two sides of the carton.

FIG. 6 shows another embodiment 600 of the invention. The shipping carton has two foldout tabs 602, 604, 606, 608 disposed on each of at least two of the side portions of the carton.

Although the invention has been described with a certain degree of particularity, it should be recognized that elements thereof may be altered by persons skilled in the art without departing from the spirit and scope of the invention. It is believed that the foldout tab of the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof, and further without providing substantial change thereto. It is the intention of the claims to encompass and include such changes.

What is claimed is:

1. A shipping carton comprising:

a product within said carton;

a plurality of side components and bottom components angularly attached to each other to form a base enclosure with a top opening;

a plurality of top components that are connected to said plurality of side components and fold shut to close the top opening;

a foldout tab disposed on a base of each of at least two of said side components, each of said foldout tabs being positioned so that said foldout tabs are extendable in an orientation that is substantially parallel with a surface on which said shipping carton rests and that is substantially coplanar with said bottom components such that said foldout tabs are capable of lying against the surface to permit a user to place a foot on each of said foldout tabs to provide leverage for the user to use when removing said product from said shipping carton through the top opening;

wherein said foldout tabs are located on opposite ones of said side components of said base enclosure such that said foldout tabs extend in opposite directions from said base enclosure when extended in said substantially coplanar relationship with said bottom components;

wherein each of said opposite side components has a width with a midline dividing each of said opposite side components into two side sections, each of said foldout tabs being substantially located on one side section of each of said opposite side components;

said product being sized such that, after said foldout tabs have been extended, removal of the product through said side components is precluded.

2. A shipping carton according to claim 1, wherein each of said foldout tabs is formed by a perforation line in said side component, the perforation line of each of said foldout tabs being positioned on a single one of said side components of the carton, each of said perforation lines having opposite ends, said opposite ends of each of said perforation lines being positioned on a single side panel of said carton.

3. A shipping carton according to claim 2, wherein each of said foldout tabs additionally include a finger tab which is also formed by perforations in one or more of said plurality of side components, each of said finger tabs being connected to one of said foldout tabs to assist in moving said foldout tabs into the extended position.

4. A shipping carton according to claim 1, wherein said foldout tabs are fixedly attached using an adhesive material.

5. A shipping carton according to claim 1, wherein said foldout tabs are fixedly attached using an adhesive tape.

6. A shipping carton according to claim 1, wherein each of said foldout tabs are fixedly attached using a screw.

7. A shipping carton according to claim 1, wherein each of said foldout tabs are fixedly attached using a rivet.

8. A shipping carton according to claim 1, wherein said foldout tabs are fixedly attached using thorns that pierce said side components.

9. A shipping carton as in claim 1, wherein at least one of the foldout tabs also forms a vent.

10. A shipping carton as in claim 1, wherein at least one of the foldout tabs is made from the same material as said carton.

11. The shipping carton according to claim 1, wherein each of said foldout tabs is formed by a perforation line, the perforation line of each of said foldout tabs being positioned on a single side of the carton, each of said perforation lines having opposite ends, said opposite ends of each of said perforation lines being positioned on a single side panel of said carton.

12. The shipping carton of claim 11, wherein said opposite ends of each of said perforation lines are located on a fold line located between a side panel of said carton and a bottom panel of said carton.

13. The shipping carton of claim 12, wherein each of said perforation lines extends along a semicircular path between opposite ends.

14. A shipping carton according to claim 1, wherein each of said foldout tabs has a perimeter, said perimeter being arcuate in shape.

15. A shipping carton according to claim 1, wherein each of said foldout tabs has a width, the width of said foldout tabs being approximately one-fourth of the width of each of said side components.

* * * * *